United States Patent [19]

Widmann et al.

[11] 3,990,289

[45] Nov. 9, 1976

[54] APPARATUS FOR STRIPPING HOLLOW ARTICLES FROM A PRESS RAM

[75] Inventors: Karl Widmann, Weissenstein; Karl Zwerina, Goeppingen, both of Germany

[73] Assignee: L. Schuler GmbH, Goeppingen, Germany

[22] Filed: May 27, 1975

[21] Appl. No.: 581,225

[30] Foreign Application Priority Data

May 24, 1974 Germany ..... 2425088

[52] U.S. Cl. ..... 72/345; 72/427

[51] Int. Cl.² ..... B21D 45/00

[58] Field of Search ..... 72/344, 345, 427

[56] References Cited

UNITED STATES PATENTS

| | | | |
|---|---|---|---|
| 2,901,995 | 9/1959 | Lavigne | 72/344 |
| 3,295,351 | 1/1967 | Jacobs | 72/344 |
| 3,935,724 | 2/1976 | Finsterwalder et al. | 72/345 |

FOREIGN PATENTS OR APPLICATIONS

| | | | |
|---|---|---|---|
| 593,849 | 3/1934 | Germany | 72/344 |

*Primary Examiner*—Lowell A. Larson
*Attorney, Agent, or Firm*—Craig & Antonelli

[57] ABSTRACT

Apparatus for stripping articles from a press ram including a plurality of individual strippers supported in ring members surrounding the press ram. Each of the strippers is formed as a rigid member having an operating piston and a stripping piston rigidly joined together by a web section with the pistons extending parallel to and laterally spaced from one another. The operating pistons of the respective strippers are rotatably supported in bores provided in a first support ring and the operating pistons are guidably supported in radial slots at a second support ring. The two rings are rotatably moved with respect to one another by way of a piston-cylinder unit, with relative rotation of the rings effecting a forced rotation of the strippers about the operating pistons into and out of respective stripping positions adjacent the press ram. The end faces of the operating pistons are communicated with a pressure medium for forcing the stripper in an axial direction to strip articles from the press ram when the strippers are rotated to an in-use stripping position.

11 Claims, 5 Drawing Figures

APPARATUS FOR STRIPPING HOLLOW ARTICLES FROM A PRESS RAM

BACKGROUND AND SUMMARY OF THE INVENTION

The present invention relates to an improved apparatus for stripping articles from press ram. Conventional apparatuses of this type, as disclosed in U.S. Pat. Nos. 3,353,394 and 3,390,565 include a plurality of strippers supported in a stripper supporting ring and mounted so that they are distributed over the circumference of the press ram and have the shape of segments, wherein thinner legs of each stripper face the press ram. Each stripper is pivotable in its plane to a limited extent in the direction toward and away from the press ram and is also displaceable in the direction of the axis of the press ram to a limited degree. All strippers are under the effect of two elastic rings, one of which rings elastically bears on all strippers during stripping in the direction of the press ram axis with respect to the stripper supporting ring, and the other of these rings, which encompasses all of the strippers, urges the strippers to pivot inwardly in the radial direction. One disadvantage of this prior arrangement is the very limited elastic movability of the individual strippers in the direction of the press ram axis. Further, this conventional apparatus has the disadvantage that the elastic forces acting on the individual strippers in the direction of the press ram axis and radially inwardly cannot be adapted to the respective ambient operating conditions without an exchange of the elastic rings. Consequently, the intended adaptation of the position of the individual strippers to the shape of the stripping edge, which stripping edge is differently shaped from one hollow article to the next, is attained during stripping only if the resistance offered against the stripping action by the hollow article lies within a range corresponding to the elasticity of the ring. If the resistance is too low or too high, the conventional apparatus becomes inoperable, because there is either no compression at all or there is a complete compression up to the rearward end position of the ring. Corresponding remarks apply with respect to the pivoting action of the strippers and the force with which the strippers contact the hollow article during passage of the press ram with this hollow article, with consequent danger of damage to the surface of the article. This last-mentioned disadvantage is of special importance insofar as there are no means provided in the conventional device to remove the strippers during the operating cycle of the press ram in the radial direction outwardly so that they are sufficiently remote from the press ram to permit passage of the ram with the hollow article without any contact with the strippers.

Similar disadvantages are likewise present in another known apparatus disclosed in German Pat. No. 593,849.

It is contemplated by the present invention to arrange the position and bearing of the strippers so that the elastic forces with which the strippers come in contact with the stripping edge of the hollow article during the stripping step can be simply adapted to the respective resistance offered against the stripping action by the hollow article. The present invention also contemplates simultaneously providing a displaceability of the individual strippers in the direction of the press ram axis to a relatively large extent. With the arrangement of the present invention, it is provided that the strippers contact the irregularly shaped stripping edge of the hollow article under all conditions which may occur and also effect the stripping step without causing an appreciable deformation or canting of the hollow article. The invention is furthermore intended for eliminating also the danger of damage to the surface of the hollow article while the same is passing through the stripper supporting ring during the operating cycle of the press ram. This last-mentioned result is obtained by the provision of a rhythmic removal of the strippers from the space where the press ram passes through.

The present invention is particularly concerned with an apparatus for stripping drawn or extruded hollow articles from a press ram which includes a stripper supporting ring having several strippers distributed over the circumference of the press ram, which strippers are pivotally and elastically mounted with each stripper having the configuration of a double angle in its radial plane containing the axis of the press ram and the stripping surface of the stripper being provided on the leg of the double angle which faces the press ram.

According to the invention, with appropriately selected length of the stripping piston portions and the operating piston portions of the strippers, and with a sufficient movability thereof in the axial direction of the press ram, the end faces of the stripping piston portions can extend to such a degree and in such a different way beyond the end face of the forward ring portion that an adaptation is made possible to strongly irregularly formed stripping edges of the hollow articles. On the other hand, by a rhythmic actuation of the drive rotating the ring segments with respect to one another, the stripping piston portions are pivoted out of the passage space of the press ram during each operating cycle of the ram. In this process, each stripper pivots about the axis of its operating piston portion.

According to preferred embodiments of the present invention, the drive for the ring segments or portions needs to rotate the rings with respect to each other merely by an angle of a few degrees in one or the other direction. Consequently, the drive for rotating the rings can be constructed in a particularly simple manner as a cylinder-piston unit which is articulated on the one hand to the forward ring portion and, on the other hand, to the rearward ring portion.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
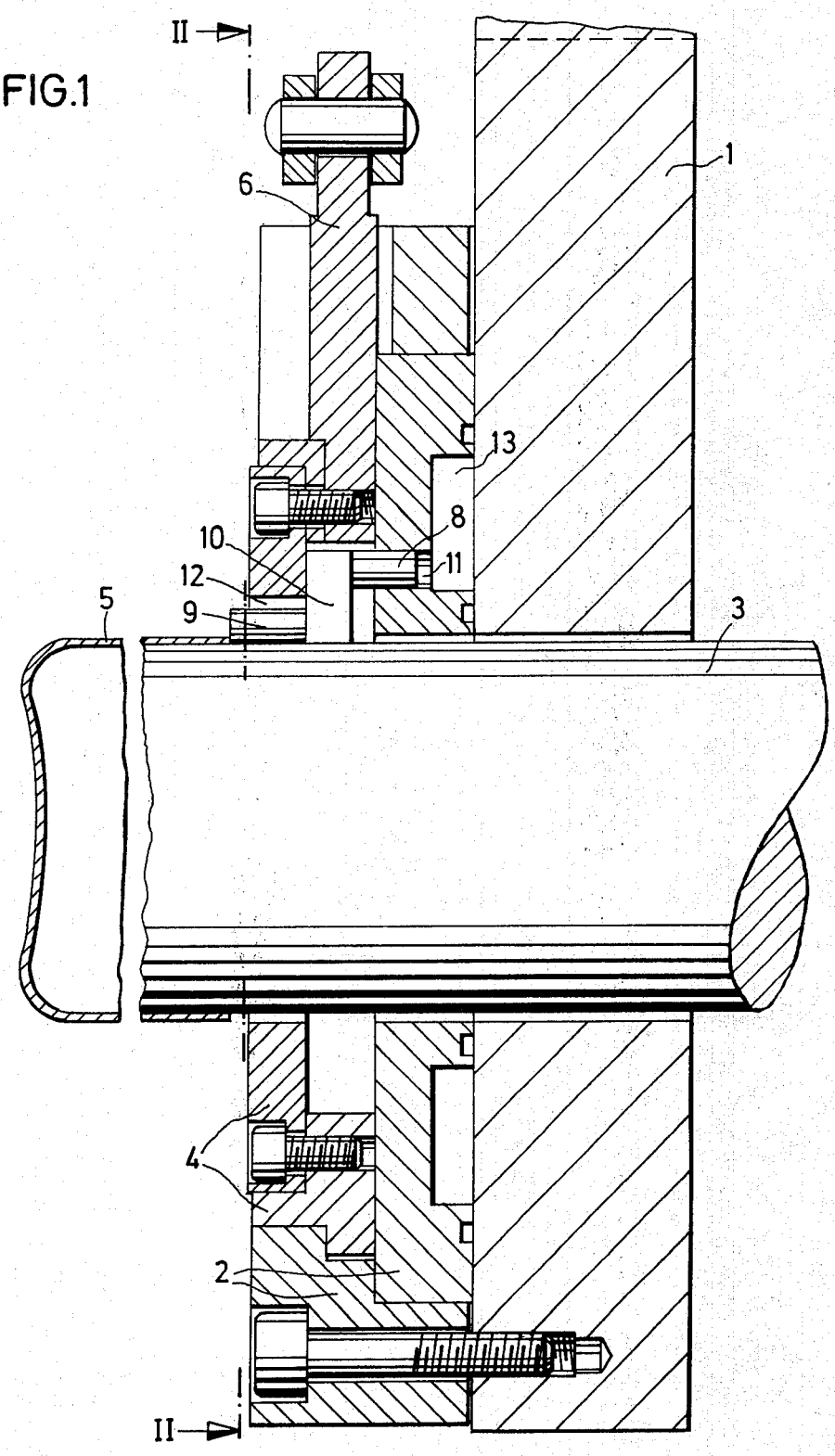
FIG. 1 is a side sectional view along line I—I of FIG. 2 illustrating a preferred embodiment of the present invention.
Figure 2:
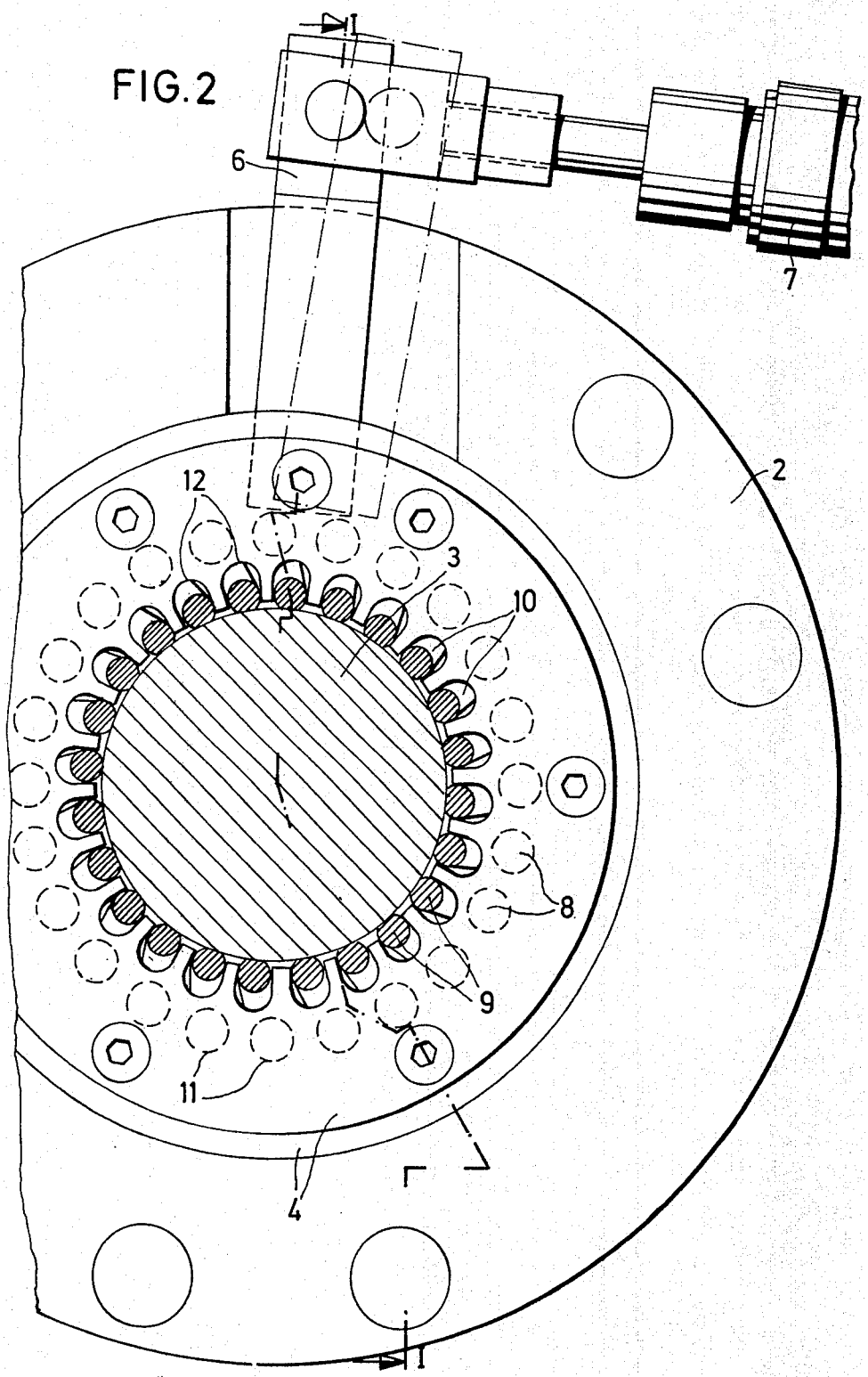
FIG. 2 is a sectional view along line II—II of FIG. 1.

A supporting plate 1, forming a component of the frame of a machine, carries at its end face a bipartite rearward ring segment 2. A bipartite forward ring segment 4 is supported in the first-mentioned ring segment and is rotatable about the axis of a press ram 3. The two ring segments 2, 4, which together form the stripper supporting ring, and the supporting plate 1 are provided with bores in alignment with each other, defining a passage space for the press ram 3 with a hollow article 5 to be stripped off the ram. An approximately radially extending arm 6 is attached to the forward ring segment 4. At the outer end of this arm 6, one end of a cylinder-piston unit 7 is articulated. The other end of the cylinder-piston unit 7 is articulated to the supporting plate 1 by means of a bearing block — not shown in the drawing. This cylinder-piston unit 7 serves as a drive which turns the two ring segments 2, 4 with respect to each other by a certain angle in one or the other direction.

Strippers are supported in the ring segments 2, 4 of the stripper supporting ring so that they are distributed over the circumference of the press ram 3. Each stripper consists of an operating piston portion 8, disposed radially with respect to the press ram farther toward the outside, a stripper piston portion 9, disposed farther toward the inside, both extending in parallel to the axis of the press ram 3, and a web section 10 joining the operating piston portion 8 and the stripping piston portion 9 with each other and extending approximately radially. The operating piston portion 8 of each stripper is rotatably mounted in a bore 11 in the inner part of the rearward ring segment 2, while the stripping piston portion 9 of each stripper is supported rotatably in a radial slot 12 in the inner part of the forward ring segment 4 so that it is radially movable. Each stripper is furthermore mounted to be displaceable to a limited extent in the direction of the axis of the press ram 3, namely between a forward end position wherein the front end face of the web section 10 contacts the rear surface of the inner part of the forward ring segment 4, and a rearward end position wherein the rear surface of the web section 10 contacts the front end face of the inner part of the rearward ring section 2.

The rearward ends of the bores 11 terminate in an annular groove 13 in the inner part of the rearward ring segment 2. A pressure medium space formed in the annular groove 13 is connected to a controllable source of pressure medium — not shown in the drawings — the pressure of this source acting on the rear surfaces of the operating piston portions 8. In the inwardly swung position, the forward end faces of the stripping piston portions 9 engage, during the stripping of the hollow article 5, the rearward stripping edge of the article, during which step the individual strippers are adjusted to the irregular shape of the stripping edge in the direction of the axis of press ram 3. In this operation, the pressure of the pressure medium source must be adjusted in accordance with the resistance offered by the hollow article 5 against the stripping from the press ram 3 in such a manner that the strippers, adjusted to the irregular form of the stripping edge of the hollow article 5, transfer the force required for the stripping operation to the stripping edge maximally uniformly distributed over the circumference of the hollow article 5.

Figure 3:
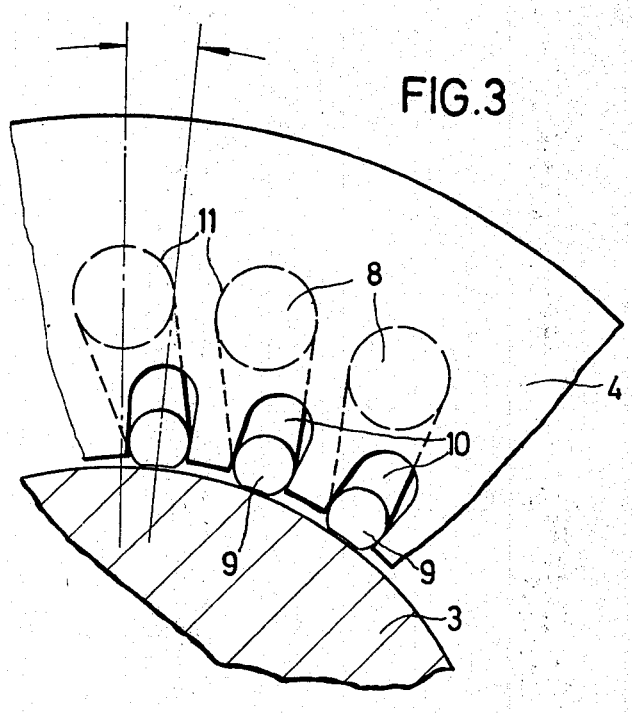
FIG. 3 is a fragmentary schematic view showing a portion of FIG. 2 on an enlarged scale with the stripping piston portions in a position close to the press ram.
Figure 4:
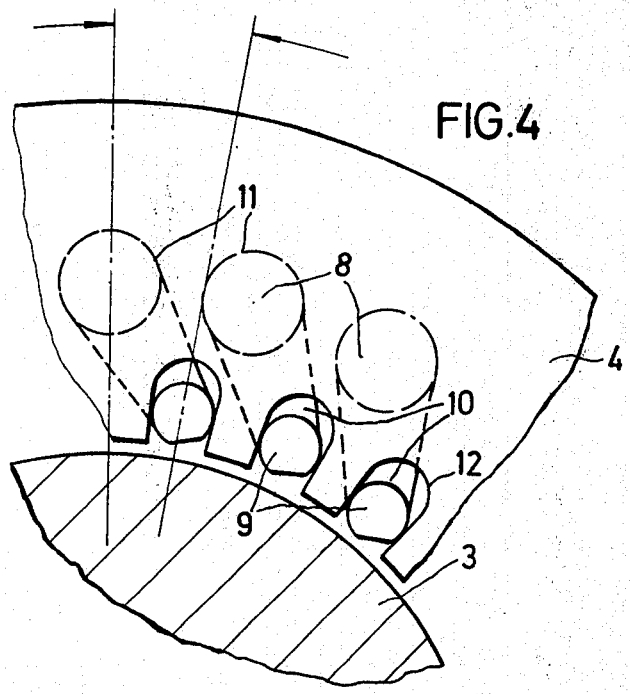
FIG. 4 is a view similar to FIG. 3 showing the stripping piston portions moved away from the press ram.
Figure 5:
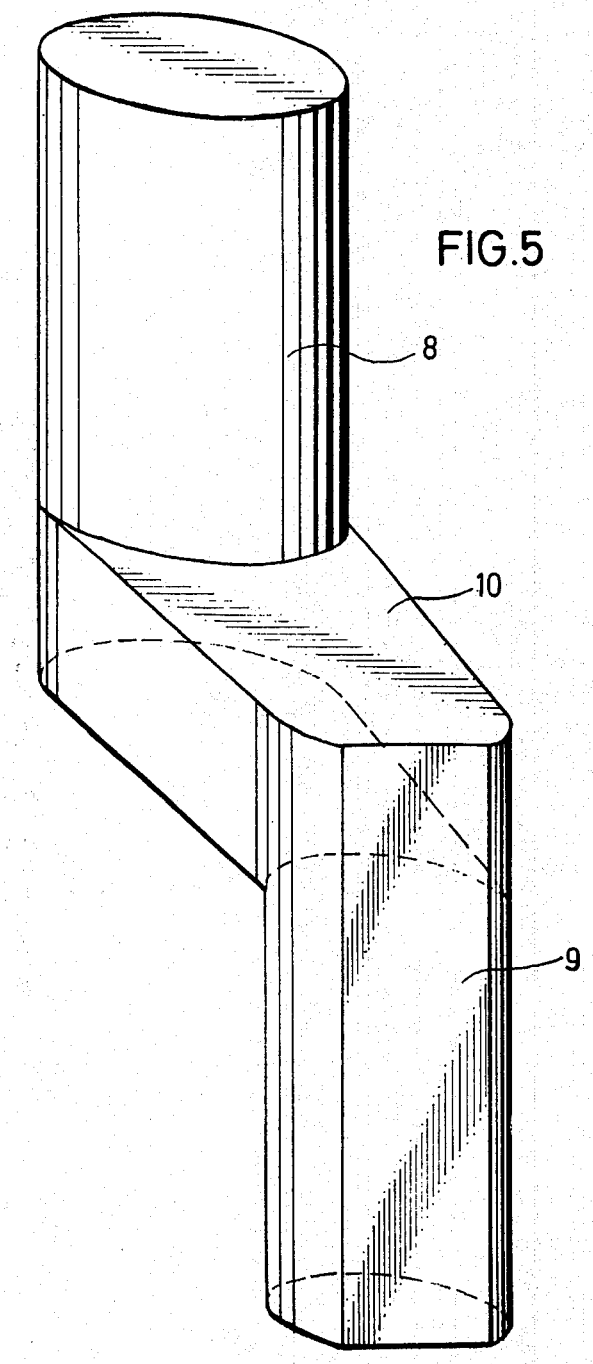
FIG. 5 is a perspective view of a single stripper on an enlarged scale.

By actuation of the cylinder-piston unit 7, the forward ring segment 4 can be rotated in either direction with respect to the rearward ring segment 2 by an angle of about 5°. In one position (FIG. 3), the stripping piston portions 9 have approached the press ram 3 by pivoting of the strippers. In the other position (FIG. 4), the stripping piston portions 9 have been removed, by pivoting of the strippers, from the passage space of the press ram 3 with the hollow article 5 seated thereon. The inner surfaces of the stripping piston portions 9, facing the press ram 3 in the first-mentioned position, have a shape adapted to the outer surface configuration of the press ram 3. The cylinder-piston unit 7 is operated rhythmically so that, during each operating cycle of the press ram 3, the stripping piston portions 9 are removed from the passage space, but during each stripping cycle of the press ram 3, the stripping piston portions 9 are in close proximity to the press ram 3.

This description has been limited to those features considered necessary for an understanding of the invention. To the extent necessary for a complete understanding of this invention, U.S. Pat. Nos. 3,353,394 and 3,390,565 and German Pat. No. 593,849 are incorporated herein. Also, co-pending commonly assigned application Ser. No. 487,057 filed July 10, 1974, now U.S. Pat. No. 3,935,724, contains related subject matter.

While we have shown and described one embodiment in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Apparatus for stripping articles from a press ram comprising:

a plurality of strippers distributed over the circumference of the press ram, each stripper including an operating piston portion and a stripping piston portion rigidly joined together by a web portion with said operating and stripping piston portions extending parallel to and laterally spaced from one another, first stripper control means for radially moving said stripping piston with respect to a press ram axis between an in-use position closely adjacent the edge of said press ram and a non-use position spaced further radially from the edge of said press ram, said first control means including means for rotating said stripper about said operating piston portion to effect said movement of said stripping piston portion between in-use and non-use positions, and second stripper control means for forcibly moving said stripper in a direction substantially parallel to said press ram axis so that said stripping piston portion can forcibly engage and strip the article from the press ram.

2. Apparatus according to claim 1, wherein said second control means includes means for applying a fluid pressure medium to an end face of said operating piston portion.

3. Apparatus according to claim 1, wherein radial edge parts of said stripping piston portion conform in shape to the press ram.

4. Apparatus for stripping articles from a press ram comprising:

a plurality of strippers distributed over the circumference of the press ram, each stripper including an operating piston portion and a stripping piston portion rigidly joined together by a web portion with said operating and stripping piston portions extending parallel to and laterally spaced from one another, first stripper control means for radially moving said stripping piston with respect to a press ram axis between an in-use position closely adjacent the edge of said press ram and a non-use position spaced further radially from the edge of said press ram, said first control means including means for rotating said stripper about said operating piston portion to effect said movement of said stripping piston portion between in-use and non-use positions, said rotating means including a first member having a bore rotatably accommodating and guiding said operating piston portion, a second member having a radial slot which accommodates and guides said stripping piston portion for radial movement between its in-use and non-use positions, and drive means for moving said first and second members with respect to one another, and second stripper control means for forcibly moving said stripper in a direction substantially parallel to said press ram axis so that said stripping piston portion can forcibly engage and strip the article from the press ram.

5. Apparatus according to claim 4, wherein said second control means includes means for applying a fluid pressure medium to an end face of said operating piston portion.

6. Apparatus according to claim 5, wherein said first member is a first ring surrounding said press ram and including respective bores for respective operating piston portions, wherein said second member is a second ring surrounding said press ram and including respective radial slots for respective stripping piston portions, and wherein said drive means includes means for rotating said first and second rings with respect to one another.

7. Apparatus according to claim 6, wherein said means for rotating said first and second rings with respect to one another is fashioned as a cylinder-piston unit articulated to the respective rings.

8. Apparatus according to claim 4, wherein said first member is a first ring surrounding said press ram and including respective bores for respective operating piston portions, wherein said second member is a second ring surrounding said press ram and including respective radial slots for respective stripping piston portions, and wherein said drive means includes means for rotating said first and second rings with respect to one another.

9. Apparatus according to claim 8, wherein said means for rotating said first and second rings with respect to one another is fashioned as a cylinder-piston unit articulated to the respective rings.

10. Apparatus according to claim 9, wherein said first ring is spaced rearwardly of said second ring with respect to the stripping direction of movement of said strippers.

11. Apparatus for stripping articles from a press ram comprising:

a stripper including an operating piston portion and a stripping piston portion rigidly joined together by a web portion with said operating and stripping piston portions extending parallel to and laterally spaced from one another, first stripper control means for radially moving said stripping piston with respect to a press ram axis between an in-use position closely adjacent the edge of said press ram and a non-use position spaced further radially from the edge of said press ram, said first control means including means for rotating said stripper about said operating piston portion to effect said movement of said stripping piston portion between in-use and non-use positions, and second stripper control means for forcibly moving said stripper in a direction substantially parallel to said press ram axis so that said stripping piston portion can forcibly engage and strip the article from the press ram.

* * * * *